US005354128A

United States Patent [19]

Lewis

[11] Patent Number: 5,354,128

[45] Date of Patent: Oct. 11, 1994

[54] CONCRETE MIXER CHUTE CAP

[76] Inventor: Thomas W. Lewis, 1267 Fremont St., San Jose, Calif. 95126

[21] Appl. No.: 93,354

[22] Filed: Jul. 19, 1993

[51] Int. Cl.[5] ..... B28C 7/16

[52] U.S. Cl. ..... 366/68; 193/6

[58] Field of Search ..... 366/68, 41, 42, 189, 366/184; 193/6, 17, 22, 21

[56] References Cited

U.S. PATENT DOCUMENTS 4,688,667 8/1987 Peterson ..... 366/68

4,711,334 12/1987 Barry ..... 193/6

*Primary Examiner*—Robert W. Jenkins

*Attorney, Agent, or Firm*—Michael L. Harrison

[57] ABSTRACT

A cover for preventing the unwanted discharge of concrete mixer chute residues from the chute, has a water impermeable cap with side panels which are gathered at the one end with an elastic band for retaining he cap in place, and which has a strong elastic retention means for holding the entire cap in place on the chute against the force of dislodging concrete particles.

1 Claim, 2 Drawing Sheets

CONCRETE MIXER CHUTE CAP

BACKGROUND OF THE INVENTION

1. Field of the Invention

The present invention relates to protective devices and, in particular to devices for preventing the spillage of concrete residues from the chutes of vehicle mounted concrete mixers.

2. Prior Art

Vehicle mounted cement mixers are an important part of virtually all construction projects. The mixers are loaded at a fixed base then, while in transit to the job site, mix the loaded ingredients. Upon arrival at the site, the mix is ready for application.

The most common method of discharging the mix is by way of a vehicle mounted discharge chute which is hinged and which is moveable to the exact location for placement of the mix. The mix is then flowed, pushed, scooped, or raked into a form where it then hardens, with or without further processing.

In the past, operation of concrete mixers employed to deliver concrete mix to construction sites have used various techniques to minimize the spillage of concrete residues during return to the mixer's fixed base.

Sometimes, the residue is washed out of the chute onto the ground in the vicinity of the site. This technique suffers from the obvious drawback that concrete residues are left behind, remaining at the washout site contaminating the environment and, at best, leaving behind a hardened, "poisoned" patch which cannot support vegetation.

The practice of washing out the chute has been proscribed by local ordinances in many communities and is considered, even when not specifically outlawed, to be an unwelcome and unsatisfactory practice.

Another technique sometimes employed is the rinsing of the chute back into the mixer tank. Although preferable to washing out onto surface soil, the technique suffers from the fact that the wash water dilutes the contents of the tank, eventually making the remainder of the load unsuitable for further use.

Of all the prior techniques, the one which is the most objectionable is to attempt to forego any washout by merely leaving the residue resting precariously in the discharge chute while the mixer is returning to its final base. The residue left in the chute is susceptible to being dislodged and then falling onto the pavement.

It is of course illegal to drop such items onto the pavement at any time. Moreover, concrete residues which have fully hardened are hazardous projectiles which all too often create damage to property in the form of broken windshields, dented or marred sheet metal, and, even worse, injury and death to persons who are struck by the flying debris.

Concrete particles as large as 4 kg. are known to form regularly in discharge chutes which have not been washed down prior to returning to streets and highways.

In addition to the risks of actual contact, drivers who are behind a truck from which residue falls will frequently make violent and unpredictable evasive maneuvers which, although successful in avoiding the concrete residue itself, result in a more violent impact with another vehicle or a stationary object. Sometimes, multiple car accidents involving numerous injuries and even death are the result.

In some regions, mixer drivers are subject to misdemeanor negligence charges for dropping mixer chute residues on public roads.

Accordingly, a need exists for an apparatus which can reliably contain concrete mixer chute residues and prevent them, when dislodged, from finding their way onto the streets and highways.

SUMMARY OF THE INVENTION

Accordingly, it is an object of the present invention to provide a protection device for containing the residue of concrete mixer discharge chutes to prevent residual pieces from causing damage to persons and property.

It is a further object of the present invention to provide for containing the residue of concrete mixer discharge chutes which is easily applied and is inexpensive to manufacture.

In general terms, the present invention accomplishes these and other objects by providing a self-retaining, self-adapting closed cap which covers the open end of a folded discharge chute with a water impermeable layer. The cap is further provided with an elastic band which snugly fits the open end of the cap to the open chute end. The overall cap is maintained in position by elastic straps which are attached to a fixed location on the discharge chute to prevent displacement of the cap due to the force of impact from residues which remain in the chute, which become dislodged and impact against the cap during transit.

The above and other features and advantages of the present invention will be set forth more completely in the description of the preferred embodiment, including the following drawings.

BRIEF DESCRIPTION OF THE DRAWINGS

FIG. 2(*b*) is a side view of a concrete mixer discharge chute cap in accordance with the present invention.

DESCRIPTION OF THE PREFERRED EMBODIMENT

Figure 1:
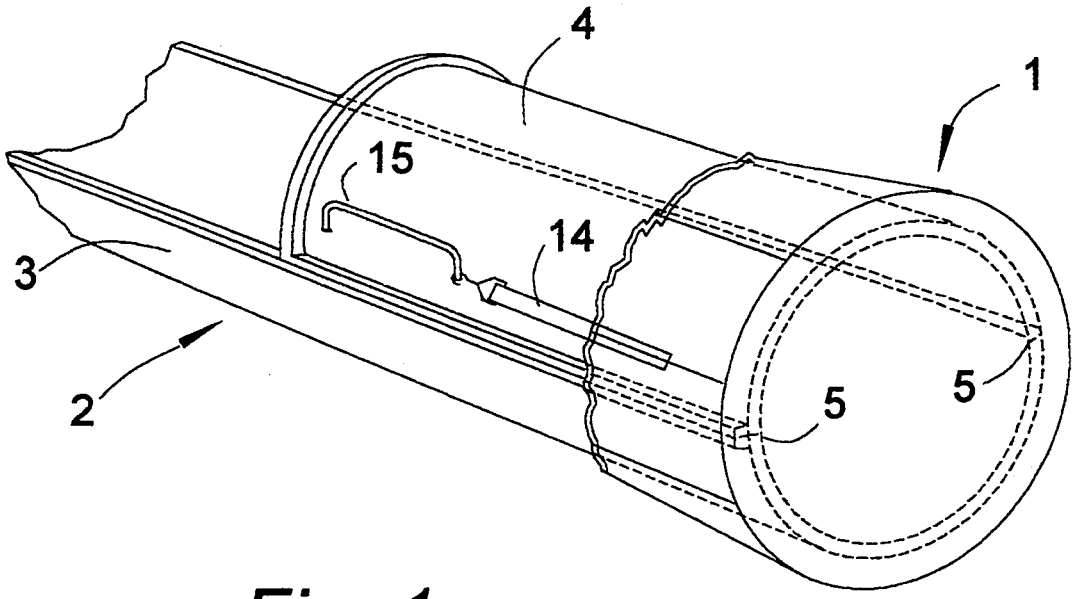
FIG. 1 is an overall perspective view of the concrete mixer discharge chute cap in accordance with the present invention, showing it installed onto a concrete mixer chute.
Figure 2A:
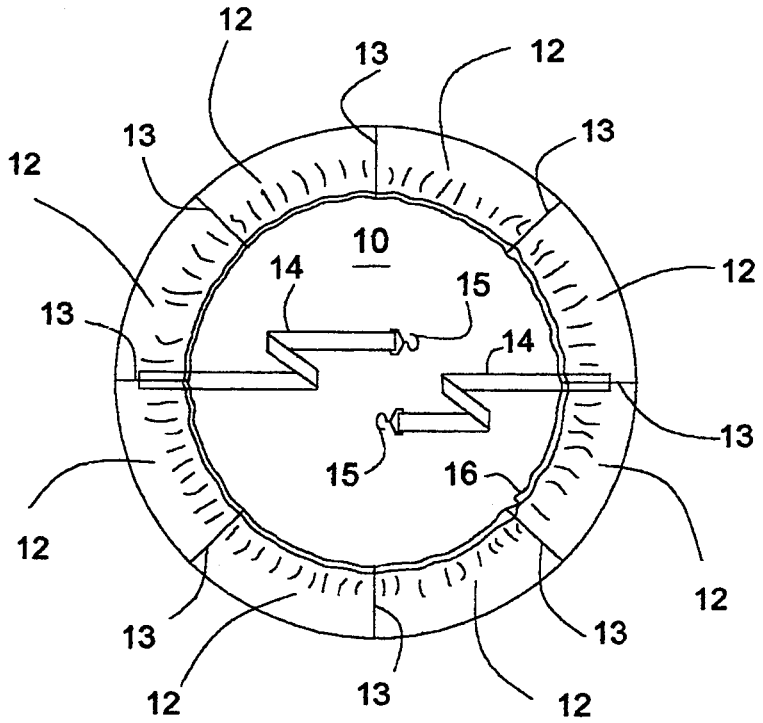
FIG. 2(*a*) is a top view of the concrete mixer discharge chute cap in accordance with the present invention.
Figure 2B:
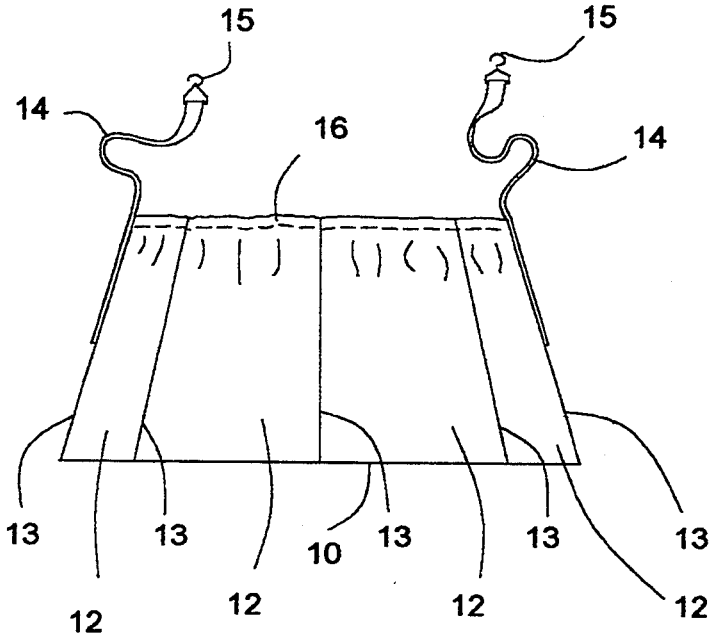

Referring now to FIGS. 1, 2, and 3, there is shown a protective concrete mixer chute cap 1 in accordance with the present invention.

In FIG. 1, the chute is shown installed onto a concrete mixer chute 2 which has been folded back onto itself for transportation.

The chute 2, which is typical of the type used, is comprised of two sections, a first section 3 and a second section 4. The sections are hinged by hinges 5 at their point of connection one to the other, so that the second section 4 may be folded back against the first section 3 for storage or for travel. At the job site, when it is desired to discharge the mixed load, the chute is unfolded to provide a continuous trough which guides the mix to its point of application.

During travel, without the present invention, residual concrete mix which remains in the chute 2 can be dislodged and can pass through the open end of the folded chute 2.

The chute cap 1 is made from a heavy duty fabric such as, nylon, canvas or other heavy duty fabric. If the fabric choice is an open weave, having no water resistant properties, it should be coated with a water proof coating, such as polyurethane, to make it water impermeable. It is necessary only to coat one side of the fabric, preferably the interior.

As shown in more detail in FIG. 2(*a*) and in FIG. 2(*b*), side panels 12 are shaped to create darts 11, which are sewn into the sides of the cap I every few inches in order to gather the material. Elastic material 16 is stretched and sewn on to the inside of the gathered material for a tight fit around the chute on a cement mixer.

To provide sufficient clearance for the hinged, reinforcement flanges and the like of the folded chute 2, the dimensions of the bottom 10 of cap 1 are made slightly larger in diameter than the largest dimension of the folded end of the chute 2.

The open end 11 of the chute cap 1 is made to have an expanded diameter which is equal to or somewhat larger than the diameter of the bottom 10 of the cap 1. This allows the open end to easily clear the flanges, hinges and the like, mentioned above.

Once installed on the folded chute 2, the open end 11 conforms, under the urging of the elastic material 15, to the contours of the chute.

Wide elastic straps 14, preferably approximately 2.5 cm wide, are attached to the side panels 12 if the chute cap 1 at points generally opposite to one another.

Although the elastic material 16 causes the cap 1 to conform snugly to the contours of the folded chute 2, the elastic material 16 alone cannot provide sufficient force to cause the cap 1 to stay in place when subjected to the forces of impact of dislodged concrete pieces. The dilemma is this: if the elastic material 16 were to provide sufficient force to prevent displacement of the cap, then it would be too resistant to expansion of the open end 11 and would prevent easy installation. On the other hand, if the elastic material 16 is made weak enough to allow easy installation, as is preferred, it will be too weak to prevent displacement of the cap 1.

The dilemma is resolved by the addition to the cap of retention straps 14.

The retaining straps 14 must be sufficiently strong to apply a retaining force which will prevent the cap 1 from being accidentally displaced by heavy concrete residues. The length of the straps is preferably great enough to reach the end of the discharge chute when the cap 1 is installed, but not so long that insufficient tension exists when the cap 1 is installed.

On some chutes, handles on the side of the chute, which arc used for handling the chute and guiding it into position, are a more suitable attachment point for the retaining straps 14.

Attachment devices 15, preferably S-hooks, are sewn onto the elastic straps 14 on one end to provide means for attachment to the cement mixer chute 2.

In use, the open end 11 of the cap 1 is expanded by hand so that it can clear the open end of the chute 2. It is then worked onto the chute 2 until the bottom 10 of the cap I is snugly against the end of the chute 2. Retention straps 14 are then stretched to reach an attachment point and are attached, leaving the straps 14 under tension.

Although a particular embodiment has been described, it will be appreciated by those skilled in the art that the present invention is not limited merely to the embodiment shown. Many variations and modifications can be made without departure from the spirit of the present invention. For example, the materials, the particular shapes, and the arrangement of the side panels and retention straps can be changed from those which are specifically illustrated. Moreover, the chute cap may be formed of different materials when different environments are encountered. Accordingly, departures from the preferred form and particularity of the present invention as described may be undertaken without departure being made from the scope of the invention, which is defined only by the claims which follow.

What is claimed is:

1. An apparatus for capturing the unintentional discharge from a concrete mixer discharge chute of the type having a first generally concave section and a second generally concave section, said sections being connected by a hinged connection such that the concave sections face one another when the second section folds back onto the first section for storage or travel, said apparatus comprising:

a flexible cap of an impermeable material, said cap having a first open end, and a second closed end, the open end having a flexible, elastic edge .having a dimension when contracted which will snugly fit over the folded concrete mixer chute at the hinged end, and which when expanded will allow the installation of the cap over the folded end of the chute;

a plurality of elastic retaining means having a first end engaged to said elastic edge, and having a second end, said elastic retaining means having a sufficient length such that the second end will reach the discharge end of the discharge chute when the cap is installed on the folded end of the chute;

engagement means affixed to the second end of the elastic retaining means, for removably engaging the end of the elastic retaining means to the end of the discharge chute or to an intermediate fixed point.

* * * * *